US006179224B1

(12) United States Patent
Huesken

(10) Patent No.: US 6,179,224 B1
(45) Date of Patent: Jan. 30, 2001

(54) PORTABLE POWER CLEANING SYSTEM

(76) Inventor: David E. Huesken, 44708 Kimberly Place, Chilliwack, B.C (CA), V2R 2Z1

( * ) Notice: Under 35 U.S.C. 154(b), the term of this patent shall be extended for 0 days.

(21) Appl. No.: 09/247,987

(22) Filed: Feb. 11, 1999

(51) Int. Cl.[7] ..... A62C 15/00

(52) U.S. Cl. ..... 239/152; 239/332; 239/289; 239/391

(58) Field of Search ..... 239/332, 152, 239/390, 532, 588, 289, 391, 436, 154; 15/321, 322; 222/285

(56) References Cited

U.S. PATENT DOCUMENTS

| | | | | |
|---|---|---|---|---|
| 199,293 | * | 1/1878 | Hodel et al. | 239/154 |
| 1,003,855 | * | 9/1911 | Adams | 239/154 |
| 1,555,467 | * | 9/1925 | Graham | 239/154 |
| 3,131,868 | * | 5/1964 | Coleman | 239/391 |
| 3,502,029 | * | 3/1970 | Halladay | 222/385 |
| 4,801,088 | * | 1/1989 | Baker | 239/332 |
| 5,013,055 | * | 5/1991 | Labrum | 280/47.19 |
| 5,263,223 | * | 11/1993 | Fiegel et al. | 15/321 |
| 5,425,589 | * | 6/1995 | Griffin et al. | 239/289 |

* cited by examiner

*Primary Examiner*—Andres Kashnikow
*Assistant Examiner*—Dinh Q. Nguyen

(57) ABSTRACT

The inventive device includes a cylindrical container having an open top, a closed bottom and a cylindrical side wall therebetween. A submersible pump is secured to an interior surface of the closed bottom of the container. The pump has an inlet and an outlet. The outlet has a supply pipe extending outwardly therefrom. The supply pipe extends upwardly along the cylindrical side wall. The supply pipe has an open free end extending outwardly of the open top of the container. The pump has a power cord extending outwardly thereof and extending outwardly of the container. A length of hose is provided having a first end and a second end. The first end is dimensioned for coupling with the open free end of the supply pipe. A plurality of attachments each have an open lower end for selective coupling with the second end of the length of hose.

7 Claims, 2 Drawing Sheets

PORTABLE POWER CLEANING SYSTEM

BACKGROUND OF THE INVENTION

1. Field of the Invention

The present invention relates to SUBMERSIBLE PUMPS and more particularly pertains to a new PORTABLE POWER CLEANING SYSTEM for CLEANING HOUSEHOLD FIXTURES QUICKLY AND EFFICIENTLY.

2. Description of the Prior Art

The use of SUBMERSIBLE PUMPS is known in the prior art. More specifically, SUBMERSIBLE PUMPS heretofore devised and utilized are known to consist basically of familiar, expected and obvious structural configurations, notwithstanding the myriad of designs encompassed by the crowded prior art which have been developed for the fulfillment of countless objectives and requirements.

Known prior art SUBMERSIBLE PUMPS include U.S. Pat. No. 5,061,157 to Arakawa; U.S. Pat. No. 5,395,052 to Schneider et al.; U.S. Pat. No. Des. 316,099 to Hartz; U.S. Pat. No. 5,201,848 to Powers; U.S. Pat. No. 5,405,086 to Kranzle; and U.S. Pat. No. 5,429,306 to Schneider et al.

While these devices fulfill their respective, particular objectives and requirements, the aforementioned patents do not disclose a new PORTABLE POWER CLEANING SYSTEM. The inventive device includes a cylindrical container having an open top, a closed bottom and a cylindrical side wall therebetween. A submersible pump is secured to an interior surface of the closed bottom of the container. The pump has an inlet and an outlet. The outlet has a supply pipe extending outwardly therefrom. The supply pipe extends upwardly alone the cylindrical side wall. The supply pipe has an open free end extending outwardly of the open top of the container. The pump has a power cord extending outwardly thereof and extending outwardly of the container. A length of hose is provided having a first end and a second end. The first end is dimensioned for coupling with the open free end of the supply pipe. A plurality of attachments each have an open lower end for selective coupling with the second end of the length of hose.

In these respects, the PORTABLE POWER CLEANING SYSTEM according to the present invention substantially departs from the conventional concepts and designs of the prior art, and in so doing provides an apparatus primarily developed for the purpose of CLEANING HOUSEHOLD FIXTURES QUICKLY AND EFFICIENTLY.

SUMMARY OF THE INVENTION

In view of the foregoing disadvantages inherent in the known types of SUBMERSIBLE PUMPS now present in the prior art, the present invention provides a new PORTABLE POWER CLEANING SYSTEM construction wherein the same can be utilized for
Cleaning Household Fixtures Quickly and Efficiently.

The general purpose of the present invention, which will be described subsequently in greater detail, is to provide a new PORTABLE POWER CLEANING SYSTEM apparatus and method which has many of the advantages of the SUBMERSIBLE PUMPS mentioned heretofore and many novel features that result in a new PORTABLE POWER CLEANING SYSTEM which is not anticipated, rendered obvious, suggested; or even implied by any of the prior art SUBMERSIBLE PUMPS, either alone or in any combination thereof.

To attain this, the present invention generally comprises a cylindrical container having an open top, a closed bottom and a cylindrical side wall therebetween. The cylindrical container has a handle pivotally coupled with the cylindrical side wall. A submersible pump is secured to an interior surface of the closed bottom of the container. The pump has an inlet and an outlet. The outlet has a supply pipe extending outwardly therefrom. The supply pipe extends upwardly along the cylindrical side wall. The supply pipe has an open free end extending outwardly of the open top of the container. The pump has a power cord extending outwardly thereof and extending outwardly of the container. The power cord is coupled with a retractable housing secured to an exterior surface of the cylindrical side wall. The pump has a power switch secured to the cylindrical side wall. A wire extends between the power switch and the pump. A length of hose is provided having a first end and a second end. The first end is dimensioned for coupling with the open free end of the supply pipe. A pair of extender tubes are provided. Each of the extender tubes have open lower ends and open upper ends. The open lower ends are dimensioned for coupling with the second end of the length of hose. A plurality of attachments are provided. The plurality of attachments include a spray nozzle, a sponge and a brush. Each of the attachments has an open lower end for selective coupling with the open upper ends of the extender tubes and the second end of the length of hose. An accessory belt is adapted for removable securement to the cylindrical side wall of the cylindrical container. The accessory belt has a plurality of receiving sleeves for receiving the plurality of attachments therein. A removable cover having an arcuate upper surface is provided. The removable cover couples with the open top of the cylindrical container. The arcuate upper surface has an outlet opening extending therethrough for receiving the open free end of the supply pipe therethrough. The arcuate upper surface has an inlet opening therethrough. The inlet opening has a perforated lid i hingedly disposed thereover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new PORTABLE POWER CLEANING SYSTEM apparatus and method which has many of the advantages of the SUBMERSIBLE PUMPS mentioned heretofore and many novel features that result in a new PORTABLE POWER CLEANING SYSTEM which is not anticipated, rendered obvious, suggested, or even implied by any of the prior art SUBMERSIBLE PUMPS, either alone or in any combination thereof.

It is another object of the present invention to provide a new PORTABLE POWER CLEANING SYSTEM which may be easily and efficiently manufactured and marketed.

It is a further object of the present invention to provide a new PORTABLE POWER CLEANING SYSTEM which is of a durable and reliable construction.

An even further object of the present invention is to provide a new PORTABLE POWER CLEANING SYSTEM which is susceptible of a low cost of manufacture with regard to both materials and labor, and which accordingly is then susceptible of low prices of sale to the consuming public, thereby making such PORTABLE POWER CLEANING SYSTEM economically available to the buying public.

Still yet another object of the present invention is to provide a new PORTABLE POWER CLEANING SYSTEM which provides in the apparatuses and methods of the prior art some of the advantages thereof, while simultaneously overcoming some of the disadvantages normally associated therewith.

Still another object of the present invention is to provide a new PORTABLE POWER CLEANING SYSTEM for CLEANING HOUSEHOLD FIXTURES QUICKLY AND EFFICIENTLY.

Yet another object of the present invention is to provide a new PORTABLE POWER CLEANING SYSTEM which includes a cylindrical container having an open top, a closed bottom and a cylindrical side wall therebetween. A submersible pump is secured to an interior surface of the closed bottom of the container. The pump has an inlet and an outlet. The outlet has a supply pipe extending outwardly therefrom. The supply pipe extends upwardly along the cylindrical side wall. The supply pipe has an open free end extending outwardly of the open top of the container. The pump has a power cord extending outwardly thereof and extending outwardly of the container. A length of hose is provided having a first end and a second end. The first end is dimensioned for coupling with the open free end of the supply pipe. A plurality of attachments each have an open lower end for selective coupling with the second end of the length of hose.

Still yet another object of the present invention is to provide a new PORTABLE POWER CLEANING SYSTEM that reduces exposure to chemicals of cleaning products.

Even still another object of the present invention is to provide a new PORTABLE POWER CLEANING SYSTEM that removed hard to get at dirt and reduces scratching of surfaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
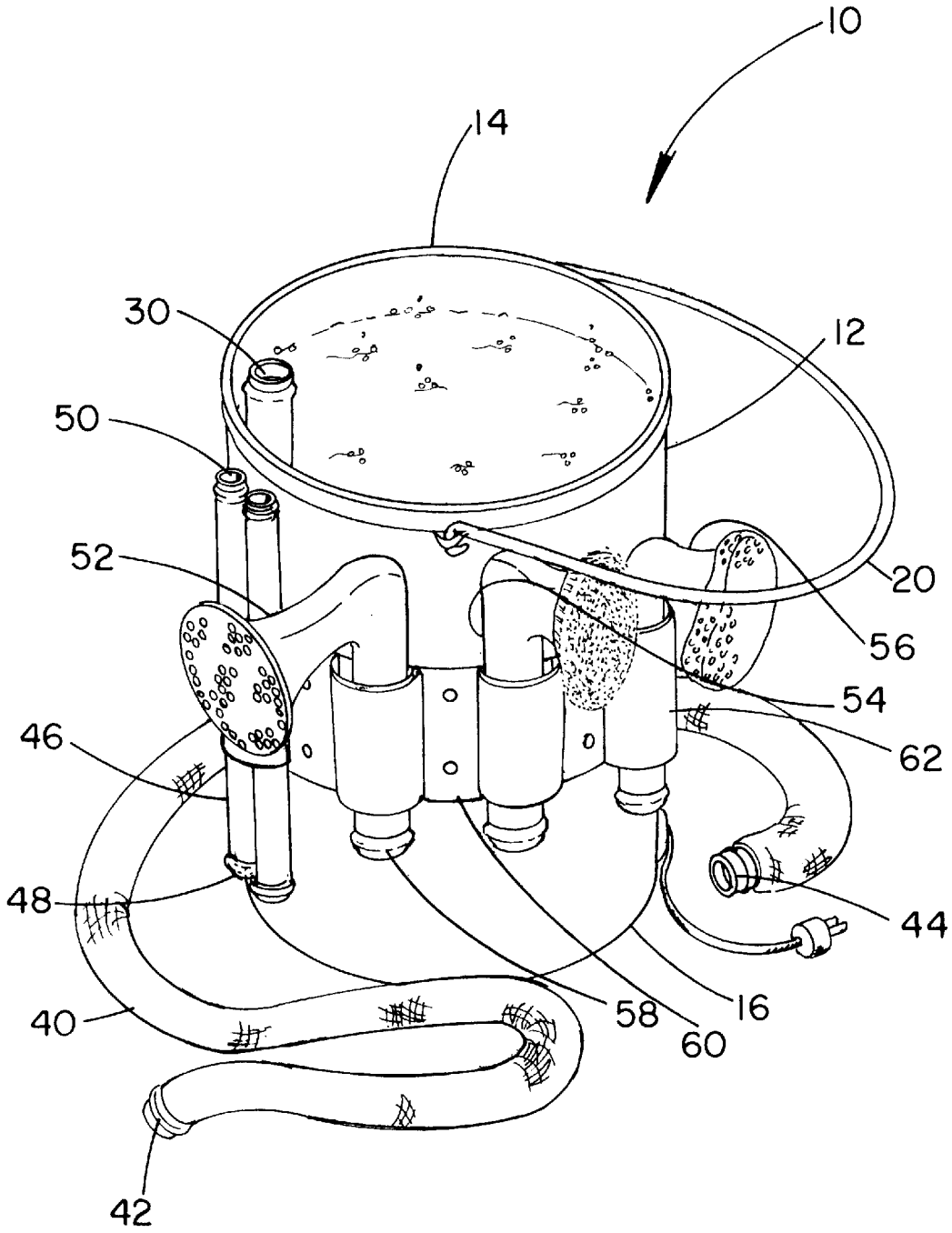
FIG. 1 is a top perspective view of a new PORTABLE POWER CLEANING SYSTEM according to the present invention.
Figure 2:
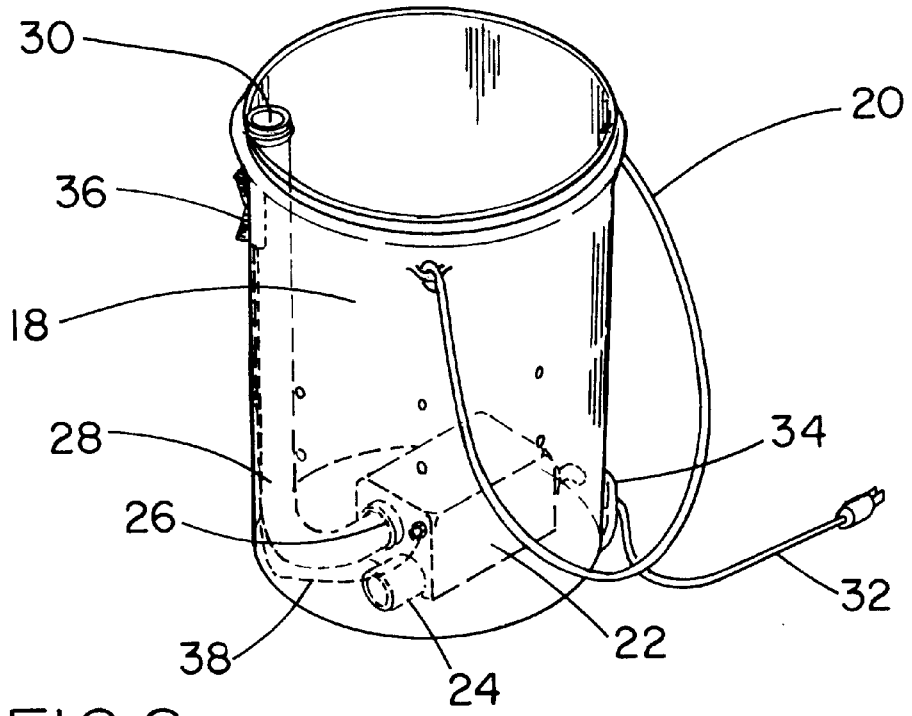
FIG. 2 is a top perspective view of the present invention with accessories thereof removed.
Figure 3:
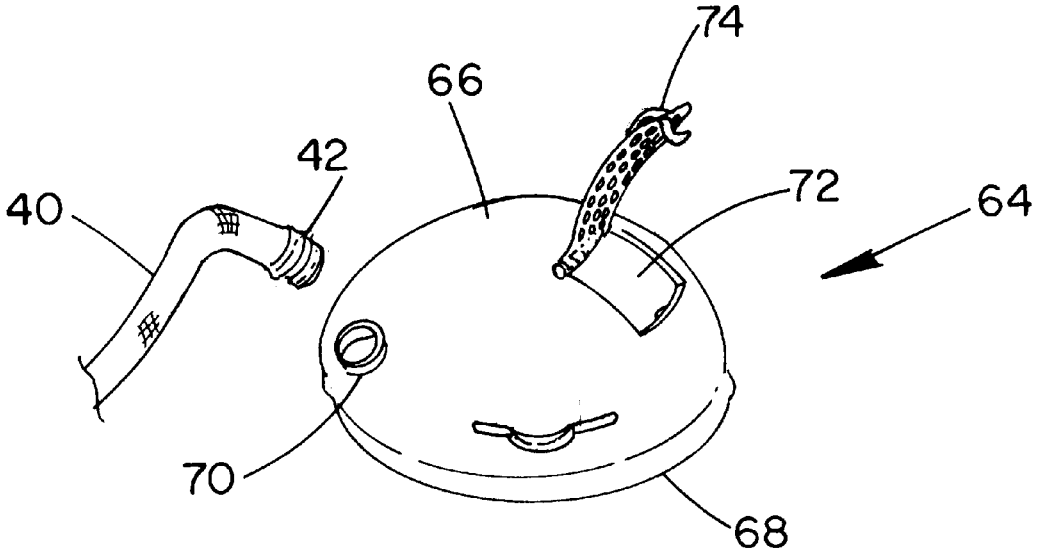
FIG. 3 is a top perspective view of the cover of the present invention.

With reference now to the drawings, and in particular to FIGS. 1 through 3 thereof, a new PORTABLE POWER CLEANING SYSTEM embodying the principles and concepts of the present invention and generally designated by the reference numeral 10 will be described.

As best illustrated in FIGS. 1 through 3, the PORTABLE POWER CLEANING SYSTEM 10 comprises a cylindrical container 12 having an open top 14, a closed bottom 16 and a cylindrical side wall 18 therebetween. The cylindrical container 12 has a handle 20 pivotally coupled with the cylindrical side wall 18. The container 12 holds a predetermined quantity of water and cleaning chemicals therein.

A submersible pump 22 is secured to an interior surface of the closed bottom 16 of the container 12. The pump 22 has an inlet 24 and an outlet 26. The outlet 26 has a supply pipe 28 extending outwardly therefrom. The supply pipe 28 extends upwardly along the cylindrical side wall 18. The supply pipe 28 has an open free end 30 extending outwardly of the open top 14 of the container 12. The pump 22 has a power cord 32 extending outwardly thereof and extending outwardly of the container 12. The power cord 32 is coupled with a retractable housing 34 secured to an exterior surface of the cylindrical side wall 18. The pump 22 has a power switch 36 secured to the cylindrical side wall 18. A wire 38 extends between the power switch 36 and the pump 22.

A length of hose 40 is provided having a first end 42 and a second end 44. The first end 42 is dimensioned for coupling with the open free end 30 of the supply pipe 28.

A pair of extender tubes 46 are provided. Each of the extender tubes 46 have open lower ends 48 and open upper ends 50. The open lower ends 48 are dimensioned for coupling with the second end 44 of the length of hose 40.

A plurality of attachments are provided. The plurality of attachments include a spray nozzle 52, a sponge 56 and a brush 54. Each of the attachments has an open lower end 58 for selective coupling with the open upper ends 50 of the extender tubes 46 and the second end 44 of the length of hose 40.

An accessory belt 60 is adapted for removable securement to the cylindrical side wall 18 of the cylindrical container 12. Snap fasteners are used in the preferred embodiment to facilitate the securement, but other means could also be employed, such as hook and loop fasteners and the like. The accessory belt 60 has a plurality of receiving sleeves 62 for receiving the plurality of attachments therein.

A removable cover 64 having an arcuate upper surface 66 is provided. The removable cover 64 couples with the open top 14 of the cylindrical container 12. The cover 64 has a lower flanged end 68 that will slide within the open top 14. The arcuate upper surface 66 has an outlet opening 70 extending therethrough for receiving the open free end 30 of the supply pipe 28 therethrough. The arcuate upper surface 66 has an inlet opening 72 therethrough. The inlet opening 72 has a perforated lid 74 hingedly disposed thereover. The inlet opening 72 allows for the addition of water and chemicals while in use. The perforated lid 74 allows for aeration.

In use, the cylindrical container 12 is filled with water and cleaning solution and then turns on the power switch 36 to activate the pump 22. The pump 22 mix the cleaning solution and the water together for use. After mixing, the water/cleaning solution mixture is pumped outwardly through the outlet opening 26 and through the supply tube 28. The length of tubing 40, with or without the use of the extenders 46, will transport the water cleaning solution mixture to the selected attachment. The spray nozzle 52 will serve to spray down the surface to be cleaned while the brush 54 and sponge 56 attachments will be used to scrub and scour the surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable power cleaning system for cleaning household fixtures quickly and efficiently comprising, in combination:

a cylindrical container having an open top, a closed bottom and a cylindrical side wall therebetween, the cylindrical container having a handle pivotally coupled with the cylindrical side wall;

a submersible pump secured to an interior surface of the closed bottom of the container, the pump having an inlet and an outlet, the outlet having a supply pipe extending outwardly therefrom, the supply pipe extending upwardly along the cylindrical side wall, the supply pipe having an open free end extending outwardly of the open top of the container, the pump having a power cord extending outwardly thereof and extending outwardly of the container, the power cord coupled with a retractable housing secured to an exterior surface of the cylindrical side wall, the pump having a power switch secured to the cylindrical side wall, a wire extending between the power switch and the pump;

a length of hose having a first end and a second end, the first end dimensioned for coupling with the open free end of the supply pipe;

a pair of extender tubes, each of the extender tubes having open lower ends and open upper ends, the open lower ends dimensioned for coupling with the second end of the length of hose;

a plurality of attachments, the plurality of attachments including a spray nozzle, a sponge and a brush, each of the attachments having an open lower end for selective coupling with the open upper ends of the extender tubes and the second end of the length of hose;

an accessory belt adapted for removable securement to the cylindrical side wall of the cylindrical container, the accessory belt having a plurality of receiving sleeves for receiving the plurality of attachments therein; and a removable cover having an arcuate upper surface, the removable cover coupling with the open top of the cylindrical container, the arcuate upper surface having an outlet opening extending therethrough for receiving the open free end of the supply pipe therethrough, the arcuate upper surface having an inlet opening therethrough, the inlet opening having a perforated lid hingedly disposed thereover.

2. A portable power cleaning system for cleaning household fixtures quickly and efficiently comprising:

a container having an open top, a closed bottom and a side wall therebetween, the container having a handle pivotally coupled to the side wall;

a submersible pump secured to an interior surface of the closed bottom of the container, the pump having an inlet and an outlet, the outlet having a supply pipe extending outwardly therefrom, the supply pipe extending upwardly along the side wall, the supply pipe having an open free end extending outwardly of the open top of the container;

a length of hose having a first end and a second end, the first end being adapted for coupling to the open free end of the supply pipe;

at least one extender tube, the at least one extender tube having an open lower end and an open upper end, the open lower end being adapted for coupling to the second end of the length of hose;

a plurality of attachments, the plurality of attachments including a spray nozzle attachment, a sponge attachment, and a brush attachment, each of the attachments having an open lower end for selective coupling to the open tipper end of the at least one extender tube and the second end of the length of hose;

an accessory belt removably mounted on an exterior surface of the side wall of the container, the accessory belt having a plurality of receiving sleeves for receiving the plurality of attachments therein; and a removable cover removably coupled to the open top of the container, the cover having an upper surface with an outlet opening extending therethrough for receiving the open free end of the supply pipe therethrough.

3. The system of claim 2 wherein the pump has a power cord extending outwardly thereof and extending outwardly of the container.

4. The system of claim 3 wherein the power cord is coupled to a retractable housing secured to an exterior surface of the cylindrical side wall.

5. The system of claim 4 wherein the pump has a power switch secured to the cylindrical side wall, a wire extending between the power switch and the pump.

6. The system of claim 2 wherein the upper surface of the cover has an inlet opening therethrough, the inlet opening having a perforated lid hingedly disposed thereover.

7. A portable power cleaning system comprising:

a container having an open top, a closed bottom and a side wall therebetween;

a submersible pump secured to an interior surface of the closed bottom of the container, the pump having an inlet and an outlet, the outlet having a supply pipe extending outwardly therefrom, the supply pipe extending upwardly along the side wall, the supply pipe having an open free end extending outwardly of the open top of the container, the pump having a power cord extending outwardly thereof and extending outwardly of the container;

a length of hose having a first end and a second end, the first end dimensioned for coupling with the open free end of the supply pipe;

a plurality of attachments each having an open lower end for selective coupling with the second end of the length of hose; and a power cord retractor having a housing having an interior and being mounted on an exterior surface of the side wall, a portion of the power cord being retractably received in the interior of the housing of the power cord retractor; and at least one extender tube couplable between the attachments and the length of hose, an accessory belt adapted for removable securement to the side wall of the container, the accessory belt having a plurality of receiving sleeves for receiving the plurality of attachments therein, and a removable cover having an arcuate upper surface, the removable cover coupling with the open top of the container, the arcuate upper surface having an outlet opening extending therethrough for receiving the open free end of the supply pipe therethrough, the arcuate upper surface having an inlet opening therethrough, the inlet opening having a perforated lid hingedly disposed thereover, wherein the pump has a power switch secured to the side wall, a wire extends between the power switch and the pump, and wherein the plurality of attachments include a spray nozzle, a sponge and a brush.

* * * * *